United States Patent [19]

Matsuo et al.

[11] Patent Number: 5,057,577

[45] Date of Patent: Oct. 15, 1991

[54] WATER AND OIL REPELLANT

[75] Inventors: Masashi Matsuo; Takashige Maekawa; Katsuji Ito, all of Yokohama, Japan

[73] Assignee: Asahi Glass Company Ltd., Tokyo, Japan

[21] Appl. No.: 492,345

[22] Filed: Mar. 12, 1990

Related U.S. Application Data

[63] Continuation of Ser. No. 319,712, Mar. 7, 1989, abandoned.

[30] Foreign Application Priority Data

Mar. 8, 1988 [JP] Japan ..... 63-52600

[51] Int. Cl.[5] ..... C08F 259/08; B05D 7/02

[52] U.S. Cl. ..... 525/276; 525/308; 525/902; 427/412

[58] Field of Search ..... 525/276, 308, 902

[56] References Cited

U.S. PATENT DOCUMENTS 3,870,767 3/1975 Grimaud et al. ..... 525/276

FOREIGN PATENT DOCUMENTS 157138 10/1985 European Pat. Off. .
2155133 5/1973 France .
2319668 2/1977 France .

*Primary Examiner*—Melvyn I. Marquis
*Assistant Examiner*—Vasa S. Jagannathan
*Attorney, Agent, or Firm*—Oblon, Spivak, McClelland, Maier & Neustadt

[57] ABSTRACT

A water and oil repellant comprising, as effective component, polymer particles each containing at least two polymers, wherein at least one of said at least two polymers is a polymer containing a polyfluoroalkyl group.

24 Claims, No Drawings

WATER AND OIL REPELLANT

This application is a continuation of application Ser. No. 319,712, filed on Mar. 7, 1989, now abandoned.

BACKGROUND OF THE INVENTION

1. Field of the Invention

The present invention relates to a water and oil repellant which satisfies drape and handle and practical durability of water and oil repellency simultaneously 2. Discussion of the Background Heretofore, a technique treating fiber products, etc. with an organic solvent solution or an aqueous dispersion containing a perfluoroalkyl group-containing compound or a copolymer obtained by polymerizing polymerizable monomer containing a perfluoroalkyl group, to impart water and oil repellency to the surface of such materials, has been known. This water and oil repellency is attributable essentially to formation of a surface with a low surface energy on the materials due to the surfacial orientation of the perfluoroalkyl groups. In addition to such essential function, the water and oil repellant of this type is required to have additional properties such as flexibility and durability including flushing resistance (hereinafter referred to simply as HL resistance), dry cleaning resistance (hereafter referred to simply as DC resistance) and abrasion resistance; flexibility and stain proofing properties; and stain proofing properties and SR properties (soil-removing properties). Particularly, for a water and oil repellant for fibers, it is highly desired to simultaneously satisfy the water and oil repellency as the essential function and the additional effects, particularly flexibility as the main additional effect. As a technique to satisfy such mutually opposing effects as the flexibility and the durability from the practical viewpoint, it has been common to employ (1) a method of improving the molecular structure of the treating agent and (2) a method of using an additional agent for the treatment. The method of improving the molecular structure of the treating agent includes a method of introducing an organopolysiloxane as a flexibility-imparting component, such as a method of employing a copolymer of a fluorine-containing (meth)acrylate with a siloxane-containing (meth)acrylate (Japanese Unexamined Patent Publication No. 190408/1975), a method of employing a reaction product of a fluorine-containing urethane compound with a reactive organopolysiloxane (Japanese Unexamined Patent Publication No. 81278/1975 or a method of using a perfluoropolyether as a side chain for a poly(meth)acrylate (Japanese Examined Patent Publication No. 6187/1976). However, a treating agent capable of providing flexibility tends to have low durability or low water and oil repellency. On the other hand, a treating agent having high durability tends to bring about poor drape and handle.

As an attempt to improve the durability, it is known to employ an additional agent for the treatment of fibers. As such a additional agent for the treatment of fibers, it is common to employ a melamine resin, a glyoxal resin or a urea resin. However, when such a resin is employed, there has been a drawback that the drape and handle tend to be poor. For the purpose of improving the flexibility, it has been proposed to use organosilicone in combination with a fluorine-containing treating agent or to apply it in a two step treatment (Japanese Unexamined Patent Publication No. 157380/1984). Although the durability may be at a satisfactory level, no practical solution has been obtained for the flexibility so long as a fluorine-containing polymer being a hard component is used as the treating agent. Further, a technique of blending a fluorine-containing polymer emulsion and a urethane compound emulsion in a latex stage, is also known particularly for treatment of fibers in an aqueous system (Japanese Unexamined Patent Publication No. 16454/1987). This technique teaches one direction for simultaneously satisfying flexibility and durability. However, in the case of simple blending of latexes, the dried coating film tends to be macroscopically nonuniform, whereby the durability (particularly the HL resistance and the abrasion resistance) tends to be low. Besides, blending different types of latexes is not easy, and it becomes very important to properly select the emulsifier to secure the stability.

SUMMARY OF THE INVENTION

It is an object of the present invention to solve the above-mentioned problems and to provide a water and oil repellant capable of satisfying the flexibility and the practical durability such as the HL resistance, DC resistance and abrasion resistance, simultaneously, which used to be difficult with the conventional treating agents or treating methods.

According to the present invention, the above object has been accomplished by providing a water and oil repellant comprising, as effective component, polymer particles each containing at least two polymers, wherein at least one of said at least two polymers is a polymer containing a polyfluoroalkyl group.

The present invention also provides a process for producing particles of a polymer containing a polyfluoroalkyl group, which comprises polymerizing a second monomer comprising at least one vinyl monomer in a polymerization system comprising particles of a first polymer obtained by emulsion polymerization of a first monomer comprising at least one vinyl monomer and a polymerization medium in the presence or absence of an emulsifier at a concentration where micelles of the second monomer hardly forms, to form a second polymer, as a polymer of the second monomer, on the surface or in the interior of the particles of the first polymer, wherein at least one of the first and second monomers contains a polyfluoroalkyl group-containing vinyl monomer.

DETAILED DESCRIPTION OF THE PREFERRED EMBODIMENTS

Now, the present invention will be described in detail with reference to the preferred embodiments.

The water and oil repellant of the present invention is used preferably in a dispersion system in water and/or a solvent, having the polymer particles dispersed. The polymer particles of the present invention, each containing at least two types of polymers, are particles composed of a first polymer in the form of particles formed by emulsion polymerization and a second polymer formed by polymerization on the surface or in the interior of the particles of the first polymer. The polymer particles are preferably of a core/shell type wherein the different polymers are phase separated in a layered structure. However, the phase separation may be of a sea/island structure, or one of the polymers may be localized. Otherwise, the molecular chains of different polymers may be interpenetrated. At least one of said at least two polymers constituting the polymer particles of the present invention is a polymer containing a polyfluoroalkyl group (hereinafter referred to simply as a Rf group.

In the present invention, the at least two polymers are micro-mixed by e.g. seeded emulsion polymerization to form polymer particles in a primary particle state where individual particles are independently present without agglomeration as distinguished from secondary particles present in an agglomerated state and as opposed to a mere blend obtained simply by mixing particles of at least two polymers.

There is no particular restriction as to the polymer containing a Rf group in the present invention. However, a homopolymer made of one of vinyl monomers containing Rf groups or a copolymer made of two or more such vinyl monomers, is preferred. The Rf groups preferably have from 3 to 21 carbon atoms, more preferably from 6 to 18 carbon atoms. Among the Rf groups, preferred are perfluoroalkyl groups containing no other atoms than the fluorine atoms, such as hydrogen atoms or chlorine atoms. Particularly preferred are those in which a vinyl monomer is located at the terminal. Preferred specific examples are as follows:

$CF_3(CF_2)_4CH_2OCOC(CH_3)=CH_2$
$CF_3(CF_2)_6(CH_2)_2OCOC(CH_3)=CH_2$
$CF_3(CF_2)_7CH_2CH_2OCOCH=CH_2$

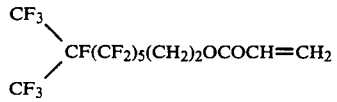

$CF_3(CF_2)_7SO_2N(C_3H_7)(CH_2)_2OCOCH=CH_2$
$CF_3(CF_2)_7(CH_2)_4OCOCH=CH_2$
$CF_3(CF_2)_7SO_2N(CH_3)(CH_2)_2OCOC(CH_3)=CH_2$
$CF_3(CF_2)_7SO_2N(C_2H_5)(CH_2)_2OCOCH=CH_2$
$CF_3(CF_2)_7CONH(CH_2)_2OCOCH=CH_2$

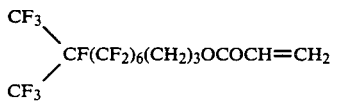

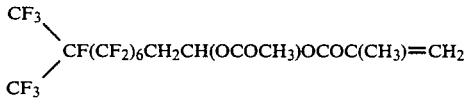

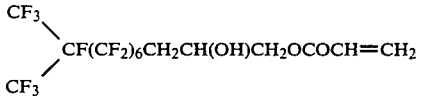

$CF_3(CF_2)_8(CH_2)_2OCOCH=CH_2$
$CF_3(CF_2)_8(CH_2)_2OCOC(CH_3)=CH_2$
$CF_3(CF_2)_8CONH(CH_2)_2OCOC(CH_3)=CH_2$

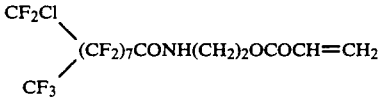

$H(CF_2)_{10}CH_2OCOCH=CH_2$
$CF_2Cl(CF_2)_{10}CH_2OCOC(CH_3)=CH_2$
$CF_3(CF_2)_5CH_2CH_2OCH_2CH_2OCH=CH_2$

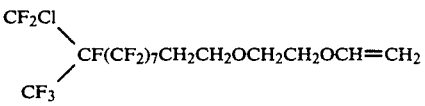

-continued $CF_3(CF_2)CH_2\underset{\underset{OH}{|}}{C}HCH_2OCH_2CH_2OCH=CH_2$

In the present invention, a polymer other than the polymer containing the Rf group, may be a homopolymer made of one of vinyl monomers containing no Rf group or a copolymer made of at least two such vinyl monomers. Such monomers may be copolymerized with the above-mentioned vinyl monomers containing the Rf groups to improve the adhesion to the substrate or the cross-linking properties of the polymers containing Rf groups, or to improve the flexibility, stain proofing properties or SR properties. Suitable specific examples of such monomers containing no Rf group are as follows.

They include, for example, ethylene, vinyl acetate, vinyl chloride, vinyl fluoride, vinylidene halide, styrene, α-methylstyrene, p-methylstyrene, acrylic acid and its alkyl ester, methacrylic acid and its alkyl ester, poly(oxyalkylene)(meth)acrylate, (meth)acrylamide, diacetone (meth)acrylamide, methylol-modified diacetone (meth)acrylamide, N-methylol(meth)acrylamide, vinyl alkyl ether, halogenated alkyl vinyl ether, vinyl alkyl ketone, butadiene, isoprene, chloroprene, glycidyl (meth)acrylate, 2-hydroxyethyl (meth)acrylate, aziridinylethyl (meth)acrylate, benzyl (meth)acrylate, isocyanate ethyl (meth)acrylate, cyclohexyl (meth)acrylate, 2-ethylhexyl (meth)acrylate, maleic anhydride, aziridinyl (meth)acrylate, polysiloxane-containing (meth)acrylate and n-vinyl carbazole.

The polymer containing the Rf group may be polymerized in the presence of a mercaptan compound as molecular weight controlling agent for the purpose of providing durability or for the purpose of imparting flexibility. Such a mercaptan compound includes, for example, $R^1$-SH wherein $R^1$ is an alkyl group or an aryl group, (HS-$R^2$)-SH wherein $R^2$ is an alkylene group,

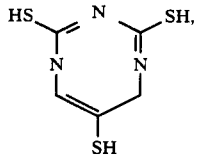

$$Aa-\overset{\overset{R^3b}{|}}{Si}O_{\frac{4-a-b}{2}} \quad \text{(Average composition),}$$

wherein A is a monovalent organic group containing a terminal mercapto group, a is $0<a<4$, $R^3$ is a nonsubstituted or substituted monovalent hydrocarbon group having at most 20 carbon atoms, provided if more than two $R^3$ exist, they may be the same or different, and b is $0 \leqq h \leqq 4$ provided $0<a+b<4$.

In order to obtain the particles each containing at least two polymers, of the present invention, it is preferred to employ so-called seeded emulsion polymerization in the presence of various polymerization initiators such as an organic peroxide, an azo compound or a persulfate, or in the presence of ionized radiation such as γ-rays.

In order to obtain core/shell type particles wherein at least two polymers are phase separated in a layered structure, firstly one polymer constituting the core is formed by emulsion polymerization in the first step, and then in the presence of the polymer, a monomer for other polymer constituting the shell is emulsion-polymerized in multi-steps of at least two steps. When this method is employed in order to obtain a water and oil repellant of the present invention, it is necessary to pay the following attention during the emulsion polymerization in the N step. Namely, it is necessary to control the amount of the emulsifier to such a level where micelles of the monomer for a shell-forming polymer hardly forms, or to the minimum amount required for the stability of the emulsion particles to avoid the presence of an excessive emulsifier to provide a fresh polymerization site in the emulsion obtained by the emulsion polymerization in the preceeding step (the N−1 step). Specifically, it is preferred to ascertain whether the emulsifier is present in an excess amount of more than the critical micelle concentration by measuring the surface tension of the emulsion upon the completion of the polymerization of the N−1 step. If the emulsifier is present in an excess amount, the emulsion may be diluted by an addition of polymerization medium to adjust the concentration of the emulsifier to a level lower than the critical micelle concentration. By this operation, the polymerization site for the emulsion polymerization in the N step will be restricted to on the particles or in the particles obtained in the preceeding N−1 step, whereby the desired particles of the present invention will be obtained.

If the emulsifier is present in an excess amount of at least the critical micelle concentration, fresh particles composed of a new composition in the N step will be formed during the polymerization, whereby it is impossible to obtain particles wherein at least two polymers are phase-separated in a layered structure. Formation of the desired particles and formation of fresh particles may be ascertained by microscopic observation employing a dyeing method, by measuring the zeta potential of the particles or by measuring the particle size distribution. Further, such formation may be ascertained also by a small angle scattering of X-rays, small angle scattering of light or small angle scattering of neutrons after the film-formation. Other than the above mentioned multi-stage polymerization, particles each containing at least two polymers, may be produced in a single step polymerization by using a combination of monomers having substantially different copolymerizability or a combination of monomers having substantially different solubilities to the polymerization medium.

The core is preferably made of a polymer containing the Rf group, and the shell is preferably made of a polymer containing a Rf group different from the polymer of the core, or a polymer containing no Rf group. The proportion of polymer units derived from the Rf group-containing monomer (Rf-containing polymer units) in the polymer containing the Rf group constituting the core, is usually from 30 to 100% by weight, preferably from 50 to 100% by weight, based on the total of the Rf-containing polymer units and the polymer units derived from the monomer containing no Rf group (Rf non-containing polymer units). If the proportion is too small, the water and oil repellency will be low. The proportion of the Rf containing polymer units in the polymer constituting the shell is likewise from 0 to 95% by weight, preferably from 0 to 80% by weight, more preferably from 0 to 70% by weight. If this proportion is too high, the improvement in the adhesion, film-forming properties or cross-linking properties will be inadequate, the durability of the water and oil repellency will be low, and the improvement in the flexibility will be inadequate. The proportion of the Rf-containing polymer units in the core is preferably higher by at least 10% by weight, preferably at least 20% by weight, than the proportion of the Rf-containing polymer units in the shell, in view of the properties.

As mentioned above, the polymers for the core and for the shell may be selected from those having different proportions of the Rf-containing polymer units. Otherwise, they may be selected among those having Rf-containing polymer units of different types, or among those having Rf-non-containing polymer units of different kinds. The ratio of the core/shell is selected within a range of from 100/1 to 1/100 by the weight ratio of the monomers constituting the core and the shell, respectively. However, the ratio is preferably from 100/5 to 100/100 for the purpose of imparting the practical durability without impairing the drape and handle for processing. Further, for the same purpose, the weight average molecular weight of the polymer for the core is preferably smaller than that of the polymer for the shell. The weight average molecular weight of the polymer for the core is usually at most about 100,000, preferably at most 50,000.

As the emulsifier to be used for the emulsion polymerization, one or more may be selected from various emulsifiers of non-ionic, cationic and anionic types. The amount of the emulsifier is usually from 1 to 20 parts by weight, preferably from 3 to 10 parts by weight, per 100 parts by weight of the polymer constituting the core in the emulsion polymerization of the first step, and it is usually from 0 to 10 parts by weight, preferably from 0.05 to 3 parts by weight, per 100 parts by weight of the polymer constituting the shell in the emulsion polymerization of the second step, not to form a polymer other than on the core. For the emulsion polymerization of the second step, the emulsifier used for the emulsion polymerization in the first step can be used continuously. Therefore, there is a case in which no additional amount of the emulsifier is added in the emulsion polymerization in the second step. The emulsifiers used in the first and second steps may be the same or different.

In the water and oil repellant of the present invention, particles composed of at least two types of polymers are present without agglomeration or in a partially agglomerated state. However, particles composed of only one kind of polymer or their agglomerates or different kinds of particles, each kind made of only one kind of polymer, may be incorporated in a small amount. The particle size of particles formed from at least two polymers according to the present invention is selected within a range of from 0.01 to 1 μm, preferably from 0.1 to 1 μm.

The water and oil repellant of the present invention is excellent in the practical durability of the water and oil repellency (HL resistance, DC resistance, abrasion resistance and durability in wearing) without impairing the drape and handle of the material treated for the water and oil repellency. Further, for the purpose of improving the drape and handle, it is effective to add, for example, a higher fatty acid, an ethylene oxide adduct of a higher fatty acid, an alkyl ester of a higher fatty acid, a long chain alcohol, a sorbitol or pentaerythritol long chain alkyl ester, a polyamide polyamine surface modifier, a synthetic wax, a liquid paraffin, a paraffin wax or silicone oil, during the emulsion polymerization or after completion of the polymerization.

To the water and oil repellant of the present invention, other water repellants or oil repellants or other polymer blends, insecticides, flame retardants, antistatic agents, dyestuffs, stabilizers, crease preventing agents or durability improvers such as a melamine resin, a glyoxal resin or a urea resin, may be in corporated.

The water and oil repellant of the present invention is preferably in the form of an aqueous emulsion and may be applied on the surface of an article to be treated by a known method for coating such as dipping or coating, followed by drying. If necessary, it may be applied together with a suitable cross-linking agent, followed by curing. In the case of a water and oil repellant of aerosol type, the application may simply be made by spraying it on the article to be treated, whereupon it is immediately dried to provide adequate performance.

There is no particular restriction as to the particles to be treated by the water and oil repellant of the present invention. Various examples may be mentioned, including fibers, fiber fabrics, glass, paper, wood, leather, fur, asbestos, bricks, cement, ceramics, metals and oxides, porcelains, plastics, coated surfaces and plasters. The fibers or fiber fabrics may be made of animal or plant natural fibers such as cotton, hemp, wool or silk, various synthetic fibers such as polyamide, polyester, polyvinyl alcohol, polyacrylonitrile, polyvinyl chloride, or polypropylene; semisynthetic fibers, such as rayon or acetate; inorganic fibers such as glass fiber or asbestos fiber, or blends of these fibers.

The mechanism whereby the water and oil repellant of the present invention provides high durability and flexibility simultaneously, is not yet clearly understood. However, in the case of particles of a core/shell type, it is considered that the mechanical strength of the water and oil repellant coating film is improved, and the surface orientation of the polyfluoroalkyl groups is enhanced by microscopic blending effects of the polymer containing a cross-linkable monomer or having a high molecular weight constituting the shell to the fluorine-containing polymer of the core. Further, it is observed that the film-forming property on the treated article is remarkably improved, and this is believed also attributable to the improvement in the durability. Furthermore, by virtue of the microscopic blending in the particles, no deterioration in the drape and handle will be brought about as opposed to the addition of an additional resin (simple blending).

Now, the present invention will be described in further detail with reference to Examples. However, it should be understood that the present invention is by no means restricted by such specific Examples.

PREPARATION EXAMPLE 1

Preparation of core polymer particles

A mixture comprising 92.52 g (178.6 mmol) of $C_8F_{17}C_2H_4OCOCH{=}CH_2$ (FA), 5.64 g (5.95 mmol) of a chain transfer agent of the formula:

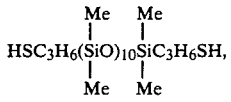

$$HSC_3H_6(\overset{\overset{Me}{|}}{Si}O)_{10}\overset{\overset{Me}{|}}{Si}C_3H_6SH,$$

2.94 g (3 parts) of water-soluble silicone (SF8427 manufactured by Toray Silicon Company), 0.49 g (0.5 part) of demethylalkylamine acetate (Farmine DMC acetate, manufactured by Lion Company), 49.1 g (50 parts) of acetone and 147.2 g (150 parts) of distilled water, were emulsified under a pressure of 450 kg/cm$^2$ by means of a high pressure emulsifying machine (homogenizer manufactured by Mantongorin Company). Then, 70 g of the obtained emulsion and 0.34 g of $\alpha,\alpha'$-azobisisobutyronitrile were charged into a 100 ml ampoule for polymerization. After flashing with nitrogen, polymerization was conducted at 75° C. for 5 hours. The yield of the core polymer particles in the obtained dispersion was at least 99%, and the particles were found to be spherical particles having an average particle size of 0.082 μm as a result of the electron microscopic observation and the measurement of the particle size distribution by a light scattering method.

PREPARATION EXAMPLES 2 to 4

Core polymer particles were prepared in the same manner as in Preparation Example 1 with the following specifications.

| Preparation Example | Monomer | Chain transfer agent | Emulsifier (parts) | Water/acetone (parts) |
|---|---|---|---|---|
| 2 | FA (92.52 g) | $HSC_3H_6(\overset{\overset{Me}{\vert}}{Si}O)_5(\overset{\overset{C_4H_4CF_3}{\vert}}{Si}O)_5\overset{\overset{Me}{\vert}}{Si}C_3H_6SH$ | SF8427 (3) FDMC (0.5) | 50/100 |
| 3 | FA (92.52 g) | — | SF8427 (3) FDMC (0.5) | 50/150 |
| 4 | FA (55.52 g) StA (37.00 g) | tert-Dodecyl SH (0.10 g) | E911 (3) Aercard T (2) | 50/150 |

StA: Stearyl acrylate
FDMC: Farmine DMC acetate type emulsifier (cationic) manufactured by Lion Company
E911: Polyoxyethylenenonylphenyl ether emulsifier (nonionic) manufactured by Kao Company Limited
Aercard T: Quarternary ammonium salt type emulsifier (cationic) manufactured by Lion Company

EXAMPLE 1

Into a 100 ml glass ampoule for polymerization, 20 g (solid content: 34%; 6.8 g; 100 parts) of the core polymer particles prepared in the Preparation Example 1, 0.68 g (10 parts) of methyl methacrylate (MMA), 0.0068 g (0.1 part) of water-soluble silicone ($SF_{8427}$), 0.017 g (2.5 parts) of 2,2-azobis(2-amidinopropane)dihydrochloride (V-50, Wako Junyaku K. K.) and 4.3 g of water, were charged to bring the concentration of the solid content to 30%. Then, after flashing with nitrogen, polymerization was conducted at 60° C. for 10 hours.

The yield of the polymer particles of core/shell type in the obtained dispersion was 99%, and the particles were found to be spherical particles having an average particle size of 0.095 μm as a result of the electron microscopic observation and the measurement of the particle size distribution by a light scattering method. The dispersion was diluted with the deionized water to a solid content of 1.6% by weight, and a PET cloth (Doskin) was dipped in the diluted dispersion and then squeezed by a mangle to a pickup of 100%, dried at 100° C. for 3 minutes and heat-treated at 175° C. for 1 minute. The cloth has flexible drape and handle. The water repellency (according to JIS L-1005) was 100, and the oil repellency (according to AATCC TM-118 1966) was 6−. The washing resistance (according to JIS L-0217-103) after washing five times (hereinafter referred to simply as HL5) and the dry cleaning resistance (according to JIS L-1092-322) after cleaning five times (hereinafter referred to simply as $DC_5$) were 5/80+ and 5/100, respectively.

EXAMPLES 2 to 7

Particles comprising polymer particles prepared in Preparation Examples 2 to 4 as core materials and the polymers identified in Table 1 as shell materials, were prepared in the same manner as in Example 1 and used for the treatment of the PET cloth in the same manner. The respective properties are shown in Table 1.

COMPARATIVE EXAMPLES 1 to 4

The dispersions (solid content concentration: 1.6% by weight) of the core polymer particles prepared in Preparation Examples 1 to 4 were diluted as they were and used for the treatment of the PET cloth in the same manner as in Example 1.

COMPARATIVE EXAMPLE 5

The dispersion of the core polymer particles having the composition as shown in Preparation Example 2 and a dispersion (solid content concentration: 17% by weight) of polymethyl methacrylate particles, were blended in a blend ratio of 100/10 to obtain a treating bath (total solid content concentration: 1.6% by weight), and the PET cloth was treated therewith in the same manner as in Example 1.

TABLE 1

| Example | Core polymer particles | Shell polymer (composition: wt %) | Initial properties Oil repellency/ water repellency | Drape | HL1 | HL3 | HL5 | DC1 | DC3 | DC5 |
|---|---|---|---|---|---|---|---|---|---|---|
| 2 | Prep. Ex 2 | MMA [10] | 6/100 | (○) | 5/100 | 5/100 | 5/80 | 5/100 | 5/80 | 4/70 |
| 3 | Prep. Ex 2 | FA/MMA [10] (30/70) | 6/100 | (○) | 6−/100 | 5/100 | 5/100 | 5/100 | 5/100 | 5/100 |
| 4 | Prep. Ex 2 | FA/MMA [10] (50/50) | 6/100 | (○) | 6/100 | 5/100 | 5/100 | 5/100 | 5/100 | 5/100 |
| 5 | Prep. Ex 2 | FA/MMA [20] (30/70) | 6/100 | (Δ) | 6/100 | 6/100 | 5/100 | 5/100 | 5/100 | 5/100 |
| 6 | Prep. Ex 3 | FA/MMA [10] (30/70) | 5/100 | (Δ) | 4/80 | 2/70 | 2/50 | 5/100 | 5/100 | 5/100 |
| 7 | Prep. Ex 4 | FA/MMA [10] (30/70) | 6−/100 | (○) | 4/80 | 3/80− | 2/50 | 5/100 | 4/80 | 4/80− |
| Comparative Example | | | | | | | | | | |
| 1 | Prep. Ex 1 | — | 4/100 | (○) | 0/50− | — | — | 4/100 | 4/100 | 4/80 |
| 2 | Prep. Ex 2 | — | 2/100 | (○) | 2/50− | — | — | 3/100 | 3/100 | 3−/90+ |
| 3 | Prep. Ex 3 | — | 1−/0 | (Δ) | — | — | — | — | — | — |
| 4 | Prep. Ex 4 | — | 6−/80− | (○) | — | — | — | — | — | — |
| 5 | Prep. Ex 2 | — | 6/100 | (Δ) | 5/70 | 3/70 | 2/50 | 5/70 | 3/70 | 2/50 |

The numerical value in [ ] indicates the proportion relative to 100 parts by weight of core material. The drape was evaluated by feeling upon touching by the following ratings:
○: Soft,
Δ: Slightly hard,
X: Hard

PREPARATION EXAMPLE 5

Preparation of core polymer particles

A mixture comprising 92.52 g (178.6 mmol) of FA, 3.35 g (11.9 mmol) of n—$C_{18}H_{37}SH$, 2.94 g (3 parts relative to 100 parts of the total of FA and mercaptan) of polyoxyethyleneoleyl ether (Emulgen 430, manufactured by Kao Company Limited), 0.29 g (0.3 part) of Farmine DMC acetate, 47.9 g of acetone and 143.8 g of distilled water, was emulsified under a pressure of 450 kg/cm$^2$ by means of a high pressure emulsifying machine (homogenizer, manufactured by Mantongorin Company) while maintaining the temperature at 50° C. Then, 70 g of the obtained emulsion and 0.34 g of α,α'-azobisisobutylonitrile were charged into a 100 ml ampoule for polymerization. After flashing with nitrogen, polymerization was conducted at 70° C. for 5 hours. Core polymer particles were obtained at a monomer conversion of at least 99%.

EXAMPLE 8

Into a 100 ml glass ampoule for polymerization, 20 g (solid content: 34%; 6.8 g; 100 parts) of the dispersion of the core polymer particles prepared in Preparation Example 5 and the monomers identified below (total amount: 2.04 g; 30 parts) were charged.

| | | (wt %) |
|---|---|---|
| $C_8F_{17}C_2H_4OC(=O)CH=CH_2$ (FA) | 0.82 g | (40) |
| tert-Butyl methacrylate | 0.61 g | (30) |
| Glycidyl methacrylate (GMA) | 0.61 g | (30) |
| Total: | 2.04 g | |

To this mixture, 0.051 g (2.5 parts) of 2,2'-azobis(2-amidinopropane)-dihydrochloride and 13.3 g of water were added to bring the concentration of the solid content to 25%. Then, after flashing with nitrogen, polymerization was conducted at 60° C. for 12 hours. The yield of the polymer particles of core/shell type in the obtained dispersion was at least 99%. The particles were found to be spherical particles having an average particle size of 0.21 μm as a result of the electron microscopic observation and the measurement of the particle size distribution by a light scattering method.

By using the obtained dispersion of the polymer particles of core/shell type, the following treating bath was prepared.

| | |
|---|---|
| Dispersion of polymer particles of core/shell type (solid content concentration: 1.6% by weight) | 19.2 g |
| Sumitex Resin M-3 (Melamine resin, manufactured by Sumitomo Chemical Company Limited) | 0.45 g |
| ACX (Organic amine curing catalyst, manufactured by Sumitomo Chemical Company Limited) | 0.45 g |
| Water | 279.9 g |
| Total: | 300 g |

A nylon fabric was dipped in the treating bath and then squeezed by a mangle to a pickup of 70%, dried at 100° C. for 90 second and heat-treated at 170° C. for 1 minute. The treated cloth had a flexible drape and handle, and the water repellency was 100, and the oil repellency was 6. The washing resistance after washing 20 times and the dry cleaning resistance after cleaning 20 times were 3/80 and 4/80−, respectively.

COMPARATIVE EXAMPLE 6

Preparation of a copolymer by charging all at once

Into a 100 ml ampoule for polymerization, the following monomers were charged. The composition for this charging was to bring the polymer composition to be substantially the same as the polymer composition of the polymer particles of core/shell type obtained in Example 8.

| | wt.% | Parts | Weight (g) |
|---|---|---|---|
| FA | 88 | | 17.6 |
| tert-Butyl methacrylate | 6 | 100 | 1.2 |
| GMA | 6 | | 1.2 |
| Emulgen 430 | — | 3 | 0.6 |
| Farmine DMC-AcOH | — | 0.3 | 0.06 |
| Acetone | — | 60 | 10.0 |
| Water | — | 150 | 30.0 |
| Stearyl mercaptan | — | 2 | 0.4 |
| V-50 | — | 2.5 | 0.5 |

The mixture in the above Table was polymerized at 60° C. for 12 hours, whereby a copolymer was obtained in a yield of at least 99%.

A nylon fabric was treated with this copolymer in the same manner as in Example 8. The results are shown in Table 2.

COMPARATIVE EXAMPLE 7

Into a 100 ml ampoule for polymerization, the following monomers were charged and polymerized at 60° C. for 12 hours, whereby a copolymer was obtained in a yield of at least 99%.

| | wt % | Parts | Weight (g) |
|---|---|---|---|
| FA | 40 | | 8.0 |
| tert-Butyl methacrylate | 30 | 100 | 6.0 |
| GMA | 30 | | 6.0 |
| Emulgen 430 | — | 4 | 0.6 |
| Farmine DMC | — | 0.3 | 0.06 |
| Acetone | — | 50 | 10.0 |
| Water | — | 150 | 30.0 |
| V-50 | — | 2.5 | 0.5 |

The dispersion of the copolymer thus obtained and the dispersion of the core polymer particles prepared in Example 5 were blended in the following blending ratio to obtain a treating bath (total solid content concentration: 1.6% by weight). A nylon fabric was treated with the treating bath in the same manner as in Example 8. The results are shown in Table 2. This blending ratio gives substantially the same polymer composition as in Example 5.

Composition of treating bath

| | |
|---|---|
| Dispersion of Preparation Example 5 (solid content concentration: 34% by weight) | 10.8 g |
| Dispersion of copolymer (solid content concentration: 34.5% by weight) | 3.2 g |
| Sumitex Resin M-3 (manufactured by Sumitomo Chemical Company Limited) | 0.45 g |
| ACX (manufactured by Sumitomo Chemical Company Limited) | 0.45 g |
| Water | To bring the total to 300 g |

A nylon cloth was treated with this treating bath. The results are shown in Table 2.

EXAMPLES 9 and 10

The treatment was conducted in the same manner as in Example 8 except that instead of the polymerizable monomer of tert-butyl methacrylate, stearyl methacrylate (StMA) and n-butyl methacrylate (n BuMA) were used. The results are shown in Table 2.

TABLE 2

| | Core polymer particles | Shell polymer (composition: wt %) | Initial WOR (Drape) | HL 20 | DC 20 |
|---|---|---|---|---|---|
| Example 8 | Prep. Ex. 5 | FA/t-BuMA/GMA [30] (40/30/30) | 6/100 (◯) | 3/80 | 4/80− |
| Example 9 | " | FA/StMA/GMA [30] (40/30/30) | 5/100 (◯) | 2/70+ | 2/70− |
| Example 10 | " | FA/n-BuMA/GMA [30] (40/30/30) | 6/100 (◯) | 3/80 | 2/80− |
| Comparative Example 6 | Copolymerization by charging all at once | FA/t-BuMA/GMA (88/6/6) | 5/100 (Δ) | 0/50− | 0/50− |
| Comparative | Blend of core polymer particles | | 6/100 (Δ) | 0/0 | 0/0 |

TABLE 2-continued

| | Core polymer particles | Shell polymer (composition: wt %) | Initial WOR (Drape) | HL 20 | DC 20 |
|---|---|---|---|---|---|
| Example 7 | of Prep. Ex. 5 and a copolymer of FA/t-BuMA/GMA (40/30/30) | | | | |

The numerical value in [ ] indicates the proportion relative to 100 parts by weight of the core material.

EXAMPLE 11

Polymerization was conduced in the same manner as in Example 8 except that 0.3 g of liquid paraffin was added to the charged composition of Example 8. The yield of the dispersion of the polymer particles of core/-shell type thus obtained was 99%, and no floating of liquid paraffin was observed on the surface of the dispersion.

A nylon fabric was treated with the dispersion in the same manner as in Example 8. The treated cloth had a wetted drape as compared with the cloth treated in Example 8. The water repellency was 100, and the oil repellency was 6. The washing resistance after washing 20 times and the dry cleaning resistance after cleaning 20 times were 3/80 and 4/80⁻, respectively.

PREPARATION EXAMPLE 6

Preparation of core polymer particles

Polymerization was conducted in the same manner as in Preparation Example 5 except that 3 g of $C_{17}H_{35}OCOOC_4H_9$ was added to the char9ed composition of Preparation Example 5 to obtain core polymer particles in a yield of at least 99%.

EXAMPLE 12

Polymerization was conducted in the same manner as in Example 8 except that the core polymer particles of Preparation Example 5 used in Example 8 was replaced by the core polymer particles of Preparation Example 6. Polymer particles of core/shell type were obtained in a yield of at least 99%. A nylon fabric was treated with dispersion of polymer particles in the same manner as in Example 8.

The cloth treated had a wetted drape as compared with the treated cloth in Example 8. The water repellency was 100, and the oil repellency was 6. The washing resistance after washing 20 times and the dry cleaning resistance after cleaning 20 times were 3/80 and 40/80-31, respectively.

EXAMPLES 13 to 16

Polymer particles of core/shell type were prepared in the same manner as in Example 8 except that the compound identified in Table 3 was added during the formation of the shell by using the polymer prepared in Preparation Example 5 as the core polymer particles and the polymerizable monomer composition shown in Example 8 as the shell material. Then, a nylon fabric was treated with the polymer particles of core/shell type in the same manner as in Example 8. The properties and the drape 20 thereby obtained are shown in Table 3.

EXAMPLES 17 to 20

The compound identified in Table 3 was emulsified and dispersed at the same time as the preparation of the core polymer particles in the Preparation Example 5, and polymer particles of core/shell type were prepared in the same manner as in Example 8, and a nylon fabric cloth was treated therewith in the same manner as in Example 8. The performance and the drape are shown in Table 3.

COMPARATIVE EXAMPLES 8 to 10

An aqueous dispersion of liquid paraffin, butyl stearate or lanolin alcohol (the composition for liquid paraffin is shown in Table 4, and similar compositions were used for butyl stearate and lanolin alcohol) was mixed to the dispersion of polymer particles of core/shell type in Example 8, and a nylon fabric cloth was treated therewith in the same manner as in Example 8. The performance and the drape ar shown in Table 5.

TABLE 3

| Example | Core polymer particles | Compound added during the preparation of shell polymer | Initial performance WOR | Compound added during the preparation of core polymer | Shell polymer | Initial performance | Drape | HL-20 | DC-20 |
|---|---|---|---|---|---|---|---|---|---|
| 13 | Prep. Ex. 5 | $C_{17}H_{35}COOC_4H_9$ | 6/100 | | | | Flexible + Wetted | 3/80 | 4/80⁻ |
| 14 | " | Lanolin fatty acid | 6/100 | | | | Flexible + Slippery | 3/80 | 4/80⁻ |
| 15 | " | $C_{16}H_{33}OH$ | 6/100 | | | | Flexible + Slippery | 3/80 | 4/80⁻ |
| 16 | " | $C_{17}H_{35}COO(C_2H_4O)_3H$ | 6/100 | | | | Flexible + Volume | 3/80 | 4/80⁻ |
| 17 | | | | Liquid paraffin | FA/tBuMA/GMA | 6/100 | Flexible + Wetted | 3/80 | 4/80⁻ |
| 18 | | | | Lanolin fatty acid | 40 30 30 | 6/100 | Flexible + Slippery | 3/80 | 4/80⁻ |
| 19 | | | | $C_{16}H_{33}OH$ | " | 6/100 | Flexible + Slippery | 3/80 | 4/80⁻ |
| 20 | | | | $C_{17}H_{35}COOH$ | " | 6/100 | Flexible + Volume | 3/80 | 4/80⁻ |

TABLE 4

| | (wt %) |
|---|---|
| Liquid paraffin | 9.68 |
| Polyoxyethylene oleyl ether | 0.29 |
| Farmine DMC acetate | 0.03 |
| Acetone | 22.5 |
| Water | 67.5 |

TABLE 5

| Comparative Example | Addition of a dispersion of polymer particles of core/shell type | Initial performance WOR | Drape | HL-20 | DC-20 |
|---|---|---|---|---|---|
| 8 | Liquid paraffin | 5/80 | Flexible + Wetted | 0/50 | 0/50 |
| 9 | $C_{17}H_{35}COOC_4H_9$ | 5/80 | Flexible + Wetted | 0/50 | 0/50 |
| 10 | Lanolin alcohol | 5/80 | Flexible + Slippery | 0/50 | 0/50 |

COMPARATIVE EXAMPLE 11

Core polymer particles were prepared in the same manner as in Preparation Example 5 except that the charged composition in Preparation Example 5 was changed as follows.

| | |
|---|---|
| FA | 92.5 g |
| Polyoxyethyleneoleyl ether | 2.78 g |
| Farmine DMC acetate | 0.27 g |
| Acetone | 46.25 g |
| Distilled water | 138.8 g |

A part of the dispersion thus obtained was poured into methanol, and the polymer was purified. Then, the molecular weight was measured by gel permeation chromatography and found to be about 200,000.

By using this emulsion as the dispersion of the core polymer particles, polymerization in the second step was conducted in the same composition a in Example 8. The molecular weight of the shell polymer was about 100,000.

The dispersion thus obtained was formed into a treating bath having the same composition as in Example 8, and a nylon fabric was treated therewith in the same manner as in Example 8. The results are shown in the following Table.

| | Molecular weight of core polymer particles | HL-20 | DC-20 | Drape |
|---|---|---|---|---|
| Example 8 | $2.0 \times 10^4$ | 3/80 | 4/80− | ○ |
| Comparative Example 11 | $2.0 \times 10^5$ | 0/50 | 4/70 | X |

EXAMPLE 21

The following monomers (total: 2.5 g; 20 parts), emulsifier for stabilizing the particles and polymerization initiator were charged to 50 g (solid content: 25%; 12.5 g 100 parts) of the dispersion of the particles prepared in Example 9, and polymerization in the third step was conducted at 60° C. for 12 hours.

| | |
|---|---|
| FA | 0.5 g (20 wt %) |
| Stearyl acrylate | 1.75 g (70 wt %) |
| Glycidyl methacrylate | 0.25 g ((10 wt %) |
| Emulgen 430 (10% aqueous solution) | 0.025 g |
| V-50 (10% aqueous solution) | 0.5 g |

The dispersion thus obtained was found to comprise spherical particles having an average particle size of 0.25 μm as a result of the electron microscopic observation and the measurement of the particle size distribution. A nylon fabric cloth was treated therewith in the same manner as in Example 8. The cloth thereby obtained had a flexible drape, and the water repellency was 100, and the oil repellency was 6. The washing resistance after washing 20 times and the dry cleaning resistance after cleaning 20 times were 4/80 and 3/80-31 , respectively.

In the water and oil repellant of the present invention, a polymer as the water and oil repelling component and a polymer as the durability component are co-existent in e.g. a core/shell form in the particles. When an article is treated therewith for water and oil repellency, it is possible to obtain high water and oil repellency and practical durability (such as HL resistance, DC resistance, abrasion resistance and durability on wearing) simultaneously without impairing the drape and handle of the treated cloth.

What is claimed is:

1. A water and oil repellant comprising, as an effective component, core/shell type polymer particles each containing at least two polymers, wherein at least one of said at least two polymers is a polymer made of one of vinyl monomers containing a polyfluoroalkyl group or a copolymer made of two or more vinyl monomers containing a polyfluoroalkyl group.

2. The water and oil repellant according to claim 1, wherein said at least two polymers comprise at least one polymer containing a high proportion of a polyfluoroalkyl group and at least one polymer containing no polyfluoroalkyl group or a relatively small proportion of a polyfluoroalkyl group.

3. A water and oil repellant comprising, as an effective component, core/shell type polymer particles each containing a first polymer formed by emulsion polymerization in the form of particles and a second polymer formed by polymerization on the surface or in the interior of the particles of the first polymer, wherein at least one of the first and second polymers is a polymer made of one of vinyl monomers containing a polyfluoroalkyl group or a copolymer made of two or more vinyl monomers containing a polyfluoroalkyl group.

4. The water and oil repellant according to claim 3, wherein one of the first and second polymers is a polymer containing a high proportion of a polyfluoroalkyl group, and the other is a polymer containing no polyfluoroalkyl group or a relatively small proportion of a polyfluoroalkyl group.

5. The water and oil repellant according to claim 3, wherein the first polymer is a polymer obtained by polymerizing a first monomer containing from 30 to 100% by weight of a polyfluoroalkyl group-containing vinyl monomer.

6. The water and oil repellant according to claim 3, wherein the second polymer is a polymer obtained by polymerizing a second monomer which contains a polyfluoroalkyl group-containing vinyl monomer in a proportion less than the proportion of the polyfluoroalkyl group-containing vinyl monomer in the first monomer for the first polymer or which contains no polyfluoroalkyl group-containing vinyl monomer, wherein the second monomer contains from 0 to 80% by weight of the polyfluoroalkyl group-containing vinyl monomer.

7. The water and oil repellant according to claim 3, wherein the first polymer is a polymer of a first monomer containing from 30 to 100% by weight of a polyfluoroalkyl group-containing vinyl monomer, and the second polymer is a polymer of a second monomer containing from 0 to 80% by weight of a polyfluoroalkyl group-containing vinyl monomer, wherein the content of the polyfluoroalkyl group-containing vinyl monomer in the first monomer is larger by at least 20% by weight than the content of the polyfluoroalkyl group-containing vinyl monomer in the second monomer.

8. The water and oil repellant according to claim 3, wherein the first polymer is a polymer of an acrylate or or methacrylate having a polyfluoroalkyl group, or a copolymer of such an acrylate or methacrylate with a monomer containing no polyfluoroalkyl group.

9. The water and oil repellant according to claim 3, wherein the second polymer is a polymer of an acrylate or methacrylate containing no polyfluoroalkyl group, or a copolymer of such an acrylate or methacrylate with an acrylate or methacrylate containing a polyfluoroalkyl group.

10. The water and oil repellant according to claim 9, wherein a part of the acrylate or methacrylate containing no polyfluoroalkyl group is a compound having an epoxy group.

11. A process for producing core/shell type particles of a polymer made of one of vinyl monomers containing a polyfluoroalkyl group or a copolymer made of two or more vinyl monomers containing a polyfluoroalkyl group, which comprises polymerizing a second monomer comprising at least one vinyl monomer in a polymerization system comprising particles of a first polymer obtained by emulsion polymerization of a first monomer comprising at least one vinyl monomer and a polymerization medium in the presence or absence of an emulsifier at a concentration where micelles of the second monomer hardly form, to form a second polymer, as a polymer of the second monomer, on the surface or in the interior of the particles of the first polymer, wherein at least one of the first and second monomers contains a polyfluoroalkyl group.

12. The process according to claim 11, wherein one of the first and second monomers contains a high proportion of a polyfluoroalkyl group-containing vinyl monomer, and the other contains no polyfluoroalkyl group containing vinyl monomer or a relatively small proportion of a polyfluoroalkyl group-containing vinyl monomer.

13. The process according to claim 11, wherein the content of the polyfluoroalkyl group-containing vinyl monomer in the first monomer is from 30 to 100% by weight.

14. The process according to claim 11, wherein the content of the polyfluoroalkyl group-containing vinyl monomer in the second monomer is from 0 to 80% by weight, and it is less than the content of the polyfluoroalkyl group-containing vinyl monomer in the first monomer.

15. The process according to claim 11, wherein the content of the polyfluoroalkyl group-containing vinyl monomer in the first monomer is from 30 to 100% by weight, and the content of the polyfluoroalkyl group-containing vinyl monomer in the second monomer is from 0 to 80% by weight, wherein the content of the polyfluoroalkyl group-containing vinyl monomer in the first monomer is larger by at least 20% by weight than the content of the polyfluoroalkyl group-containing vinyl monomer in the second monomer.

16. The process according to claim 11, wherein the first monomer is an acrylate or methacrylate containing a polyfluoroalkyl group, or a mixture of such an acrylate or methacrylate with a vinyl monomer containing no polyfluoroalkyl group.

17. The process according to claim 11, wherein the second monomer is an acrylate or methacrylate containing no polyfluoroalkyl group, or a mixture of such an acrylate or methacrylate with an acrylate or methacrylate containing a polyfluoroalkyl group.

18. The process according to claim 17, wherein a part of the acrylate or methacrylate containing no polyfluoroalkyl group is a compound containing an epoxy group.

19. The process according to claim 11, wherein the first monomer is emulsion-polymerized in the presence of an emulsifier, a polymerization initiator and a polymerization medium to prepare an emulsified polymer composition containing particles of the first polymer, and polymerization of the second monomer is conducted in the emulsified polymer composition without adding no substantial amount of an emulsifier afresh and, if necessary, with an addition of a polymerization medium.

20. The process according to claim 19, wherein the polymerization medium is water or a mixture of water with a water-soluble organic solvent.

21. The process according to claim 19, wherein the first monomer is emulsion-polymerized in the presence of an emulsifier, a polymerization medium, a polymerization initiator and a chain transfer agent.

22. The process according to claim 19, wherein the second monomer is polymerized in the presence of the emulsifier used for the polymerization of the first monomer and if the concentration of the emulsifier is at a level where micelles of the second monomer are likely to form, a polymerization medium is added to dilute the emulsified polymer composition to bring the concentration of the emulsifier to a level where micelles of the second monomer hardly form and the polymerization of the second monomer is conducted in the presence of a fresh polymerization initiator.

23. A water and oil repellant comprising, as effective component, polymer particles obtained by the method of claim 11.

24. Core/shell type polymer particles comprised of at least two polymers, wherein at least one of said at least two polymers is a polymer made of one of vinyl monomers containing a polyfluoroalkyl group or a copolymer made of two or more vinyl monomers containing a polyfluoroalkyl group, and wherein said at least two polymers are phase separated.

* * * * *